US007899378B2

(12) United States Patent
Lee et al.

(10) Patent No.: US 7,899,378 B2
(45) Date of Patent: Mar. 1, 2011

(54) IMAGE FORMING APPARATUS HAVING MOVABLE BELT

(75) Inventors: Se-ra Lee, Suwon-si (KR); Myung-ho Kyung, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 867 days.

(21) Appl. No.: 11/643,800

(22) Filed: Dec. 22, 2006

(65) Prior Publication Data

US 2008/0019741 A1 Jan. 24, 2008

(30) Foreign Application Priority Data

Jul. 21, 2006 (KR) ..... 10-2006-0068735

(51) Int. Cl.
*G03G 15/01* (2006.01)

(52) U.S. Cl. ..... 399/302; 474/101; 198/806

(58) Field of Classification Search ..... 399/162, 399/165, 302, 303, 308, 312, 313, 329; 198/804, 198/806, 810.03; 474/101, 111, 122, 140
See application file for complete search history.

(56) References Cited

U.S. PATENT DOCUMENTS 5,896,979 A * 4/1999 Hokari et al. ..... 198/807
6,101,362 A 8/2000 Shimura et al.
6,141,522 A * 10/2000 Tsuruoka et al. ..... 399/302
6,160,978 A 12/2000 Tsuruoka et al.
7,565,095 B2 * 7/2009 Mori ..... 399/165
7,680,445 B2 * 3/2010 Kim ..... 399/302
2004/0076455 A1 4/2004 Fujiwara
2005/0095041 A1 * 5/2005 Kim et al. ..... 399/302
2007/0041754 A1 * 2/2007 Hachisuga et al. ..... 399/302
2008/0205944 A1 * 8/2008 Lee et al. ..... 399/302

FOREIGN PATENT DOCUMENTS

JP 2002023509 A * 1/2002
JP 2002132057 A * 5/2002
JP 2004-149241 5/2004

OTHER PUBLICATIONS

Extended European Search Report dated Nov. 13, 2007 issued in EP 07106773.0.

* cited by examiner

*Primary Examiner*—Robert Beatty
(74) *Attorney, Agent, or Firm*—Stanzione & Kim LLP

(57) ABSTRACT

An image forming apparatus includes at least one supporting roller, a movable belt supported by the supporting roller, and a shifting restricting unit to prevent the movable belt from shifting to any one side along an axial direction of the supporting roller. The shifting restricting unit includes a guide rail formed between the movable belt and the supporting roller to guide movement of one end of the movable belt, and a belt pressurizing member formed at the other end of the movable belt to generate tension on the movable belt to compensate for a shifting force on the guide rail side by the guide rail.

4 Claims, 4 Drawing Sheets

IMAGE FORMING APPARATUS HAVING MOVABLE BELT

CROSS-REFERENCE TO RELATED APPLICATIONS

This application claims priority under 35 U.S.C. §119 from Korean Patent Application No. 2006-68735, filed on Jul. 21, 2006, in the Korean Intellectual Property Office, the entire contents of which are incorporated herein by reference.

BACKGROUND OF THE INVENTION

1. Field of the Invention

The present general inventive concept relates to an image forming apparatus in which a movable belt is movably installed to transfer an image formed on an image retainer to a printing medium.

2. Description of the Related Art

In general, an image forming apparatus, such as a laser color printer, includes an image retainer, such as a photoconductive drum, on which an image is developed, and a movable belt for transferring the image developed on the photoconductive drum to printing paper, namely, an intermediate transfer medium. Developing units for each color which sequentially develop Y, M, C and K color images on the photoconductive drum are installed around the photoconductive drum.

One example of the intermediate transfer medium is an intermediate transfer belt moving in contact with the photoconductive drum. Each color image is transferred from the photoconductive drum to the intermediate transfer belt in an overlapping type operation, so that the intermediate transfer belt can acquire a target color image. The final color image formed by overlapping is transmitted to a recording medium moving in contact with the intermediate transfer belt.

The intermediate transfer belt, supported by a plurality of supporting rollers including a driving roller and a tension roller, moves in one direction and transfers the overlap-transferred color image to the recording medium. The driving roller supplies power for moving the intermediate transfer belt, and the tension roller adjusts tension of the intermediate transfer belt. The length of the intermediate transfer belt eventually changes as a result of effects of the environment. Thus, the intermediate transfer belt can move under constant tension by adjusting the position of the tension roller.

On the other hand, while the intermediate transfer medium moves while supported by the driving roller and the tension roller, the intermediate transfer medium may shift to any one side due to mechanical errors of the supporting rollers. To solve the foregoing problem, guide rails are formed at both sides of the movable belt and both ends of the supporting rollers to support the movable belt. The guide rails formed at both sides of the movable belt prevent the movable belt from shifting to any one side along the axial directions of the supporting rollers, and guide the movable belt to move in a constant path.

However, when the guide rails are formed at both sides of the movable belt, a number of components increases to raise the unit cost of production.

To solve the above problem, there has been an attempt to reduce the number of the components and restrict shifting of the movable belt in side directions by forming the guide rail at one side of the movable belt. FIG. 1 is a schematic structure diagram illustrating a conventional movable belt disclosed under U.S. Pat. No. 5,017,969. Referring to FIG. 1, a guide groove 11 is formed at one end of a supporting roller 10, and the movable belt 20 supported by the supporting roller 10 includes a guide rib 21 corresponding to the guide groove 11. The guide rib 21 is inserted into the guide groove 11 to prevent the movable belt 20 from shifting in a B1 direction.

In the above structure, a number of components are reduced and shifting of the movable belt 20 in one direction B1 is prevented by forming the guide rail 11 and guide rib 21 at one side of the movable belt 20. However, it is difficult to restrict shifting of the movable belt 20 in another direction B2. That is, the movable belt 20 shifts in the B2 direction due to a sum force F3 of a tension F1 applied to the movable belt 20 by the supporting roller 10 and a control force F2 moving the movable belt 20 in the B2 direction by the guide rail 11 and guide rib 21.

SUMMARY OF THE INVENTION

The present general inventive concept provides an image forming apparatus having an improved structure which can apply a guide rail to one side of a movable belt and prevent shifting of the movable belt.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus, including: at least one supporting roller; a movable belt supported by the supporting roller; and a shifting restricting unit to prevent the movable belt from shifting to any one side along the axial direction of the supporting roller, wherein the shifting restricting unit includes: a guide rail formed between the movable belt and the supporting roller, to guide movement of one end of the movable belt; and a belt pressurizing member formed at the other end of the movable belt, to generate tension on the movable belt to compensate for a shifting force to the guide rail side by the guide rail.

The guide rail may include a guide groove formed on the outer circumference of one end of the supporting roller and a guide rib formed inside the movable belt to be inserted into the guide groove.

The guide rail may further include a flange protruding from one end of the supporting roller higher than the outer circumference of the supporting roller to support the end of the movable belt.

The belt pressurizing member may include a reinforcing film formed inside the other end of the movable belt at a predetermined width, to contact the outer circumference of the supporting roller and generating a step difference at the other end of the movable belt; and an adhesive formed between the reinforcing film and the movable belt at a predetermined thickness.

The reinforcing film may be thinner than the movable belt and thicker than the adhesive.

When Young's module of the movable belt is 2000 Mpa and the thickness of the movable belt ranges from approximately 65 to approximately 85 μm, the thickness of the belt pressurizing member ranges from approximately 70 to approximately 110 μm.

The foregoing and/or other aspects and utilities of the present general inventive concept may also be achieved by providing a transfer assembly useable with an image forming apparatus, comprising: a transfer roller including a flange at one end thereof having a larger circumference than a circumference of the transfer roller and a guide groove formed therein adjacent to the flange; and a transfer belt in pressure contact with the transfer roller to rotate around the transfer roller, the transfer belt including a guide rail disposed at an inner surface at one side thereof to be guided within the guide groove and adjacent to the flange and a reinforcing film disposed at an inner surface of the other side thereof to be guided along the other end of the transfer roller.

The transfer assembly may further comprise another transfer roller disposed in parallel with the transfer roller including the flange and guide groove to rotatably support another end of the transfer belt, wherein one of the another transfer roller and the transfer roller including the flange and guide groove is a pressure roller to apply a pressure on the transfer belt in a direction away from the other transfer roller.

The foregoing and/or other aspects and utilities of the present general inventive concept may also be achieved by providing a method of preventing sliding movement of a transfer belt along axial directions of a pair of transfer rollers, comprising: applying a first force on one side of the transfer belt with a first belt pressurizing assembly; and applying a second force on another side of the transfer belt in a direction opposing the first force with a second belt pressurizing assembly.

The first force can be a sum force of a tension force applied on the transfer belt from one of the transfer rollers and the second force is a force applied on the transfer belt from the first belt pressurizing assembly and second force is a sum forced of a tension force applied on the transfer belt from the one of the transfer rollers and another tension force applied on the transfer belt from a step in the belt caused by the second belt pressurizing assembly.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
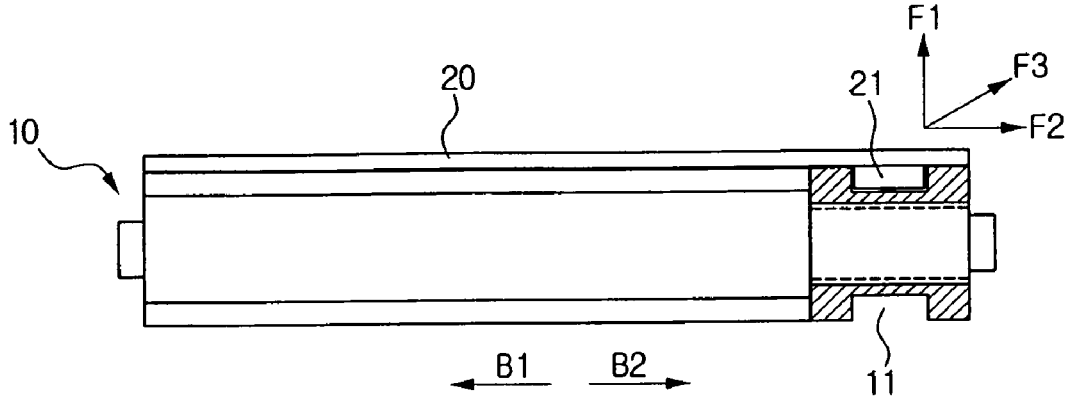
FIG. 1 (PRIOR ART)
FIG. 1 is a schematic structure diagram illustrating a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
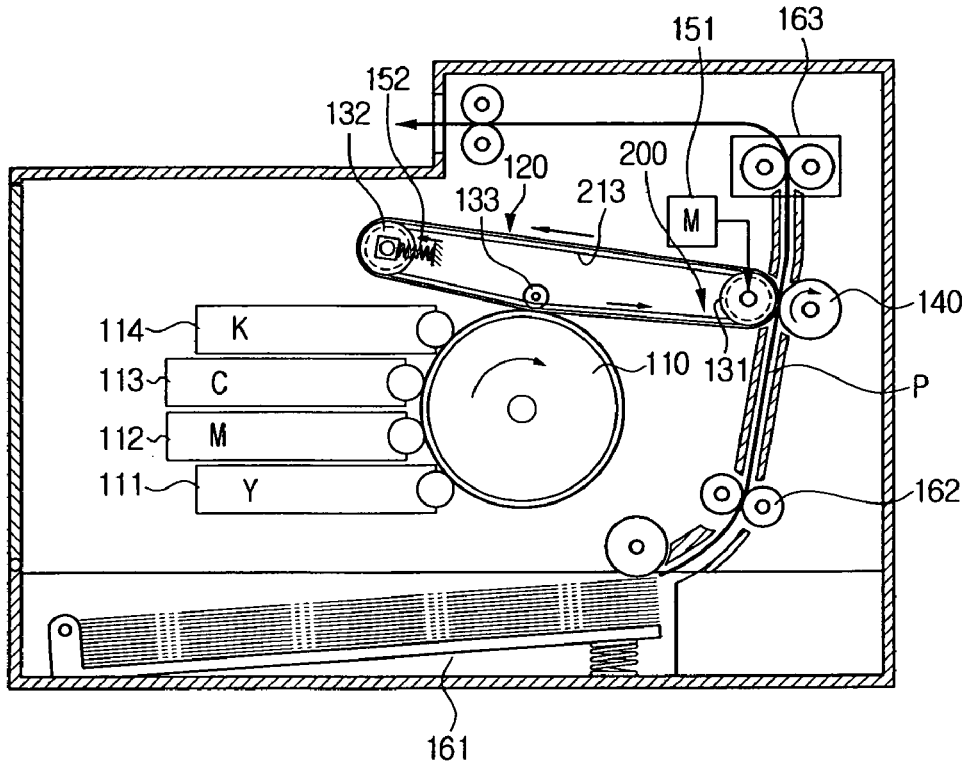
FIG. 2 is a schematic structure diagram illustrating an image forming apparatus in accordance with an exemplary embodiment of the present general inventive concept.

FIG. 2 is a schematic structure diagram illustrating the image forming apparatus in accordance with the exemplary embodiment of the present general inventive concept.

As illustrated in FIG. 2, the image forming apparatus includes an image retainer 110, a movable belt 120 (hereinafter, referred to as 'intermediate transfer belt') to which an image formed on the image retainer 110 is primarily transferred, a plurality of supporting rollers 131 and 132 to support the intermediate transfer belt 120 to be movable, a secondary transfer roller 140 connected or disconnected to/from the intermediate transfer belt 120, to aid in the transfer of the image on the intermediate transfer belt 120 to a printing medium P, and a shifting restricting unit 200 to restrict shifting of the intermediate transfer belt 120, namely, to prevent the intermediate transfer belt 120 from shifting to any one side along the axial directions of the supporting rollers 131 and 132.

The image retainer 110 is rotated by a primary transfer roller 133 with a primary transfer nip from the intermediate transfer belt 120. Developing units 111, 112, 113 and 114 for each color which sequentially develop Y, M, C and K color images on the image retainer 110 are installed in the rotating direction of the image retainer 110. The developing units 111, 112, 113 and 114 form each color image on the image retainer 110. The color images formed on the image retainer 110 are sequentially transferred to the intermediate transfer belt 120 in an overlapping type operation.

The intermediate transfer belt 120 moves in one direction, supported by the plurality of supporting rollers 131 and 132. One of the supporting rollers 131 and 132 is a driving roller 131 that is rotated by a driving motor 151, and the other supporting roller is a tension roller 132 that is outwardly pressurized by a pressurizing member 152. The tension roller 132 pressurizes and supports the intermediate transfer belt 120 by the pressurizing member 152 to maintain a constant tension on the intermediate transfer belt 120. The tension roller 132 is rotated by a friction force with the intermediate transfer belt 120, which moves by a power of the driving roller 131.

The full color image, which is overlap-transferred to the intermediate transfer belt 120 from the image retainer 110, is transferred to the printing medium P that passes through a secondary transfer nip formed between the secondary transfer roller 140 and the intermediate transfer belt 120.

The printing medium P is picked up from a paper feeding cassette 161 of the image forming apparatus, aligned by a register roller 162, and supplied to the secondary transfer nip between the secondary transfer roller 140 and the intermediate transfer belt 120. While the printing medium P passes through the secondary transfer nip, the image is transferred from the intermediate transfer belt 120 to the printing medium P. Thereafter, the printing medium P is transferred to a fixing unit 163. While the printing medium P passes through the fixing unit 163, it is fixed by a high temperature and a high pressure, and then externally discharged.

On the other hand, in order to precisely transfer each color image from the image retainer 110 to the intermediate transfer belt 120 in an overlapping type operation, it is very important to control the intermediate transfer belt 120 to stably move without shifting to any one side.

Figure 3:
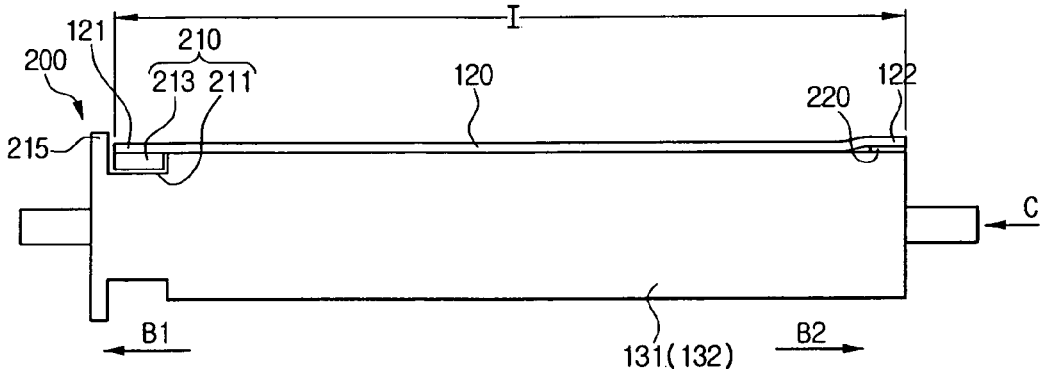
FIG. 3 is a structure diagram illustrating a coupling state of an intermediate transfer belt and a supporting roller of FIG. 2.

The shifting restricting unit 200 restricts shifting of the intermediate transfer belt 120. For example, the shifting restricting unit 200 prevents the intermediate transfer belt 120 from shifting along the axial directions of the rollers 131 and 132. As illustrated in FIG. 3, the shifting restricting unit 200 includes a guide rail 210 formed at one end of the intermediate transfer belt 120, and a belt pressurizing member 220 formed at the other end of the intermediate transfer belt 120.

The guide rail 210 includes a guide groove 211 formed at one end of the support roller 131 or 132, and a guide rib 213 formed on the inner surface of one side of the intermediate transfer belt 120 to be inserted into the guide groove 211. The guide groove 211 is formed into the outer circumference of one end of the supporting roller 131 or 132 by a predetermined depth and width. The guide rib 213 is adhered to an inner surface of one side of the intermediate transfer belt 120 by an adhesive. The guide rib 213 can be made of polyurethane to be flexibly transformed like the intermediate transfer belt 120.

The guide rail 210 can further include a flange 215 that protrudes from one end of the supporting roller 131 or 132 to a length that is higher than the outer circumference of the supporting roller 131 or 132 on which it protrudes. The flange 215 acts as the outer wall of the guide groove 211 and supports one side of the intermediate transfer belt 120.

In the structure of the guide rail 210, the guide rib 213 is thicker than the intermediate transfer belt 120, and the guide groove 211 is formed deeper into the supporting roller 131 or 132 than the thickness of the guide rib 213. Accordingly, the intermediate transfer belt 120 stably moves along the guide rail 210 without shifting in a B2 direction as illustrated.

Figure 4:
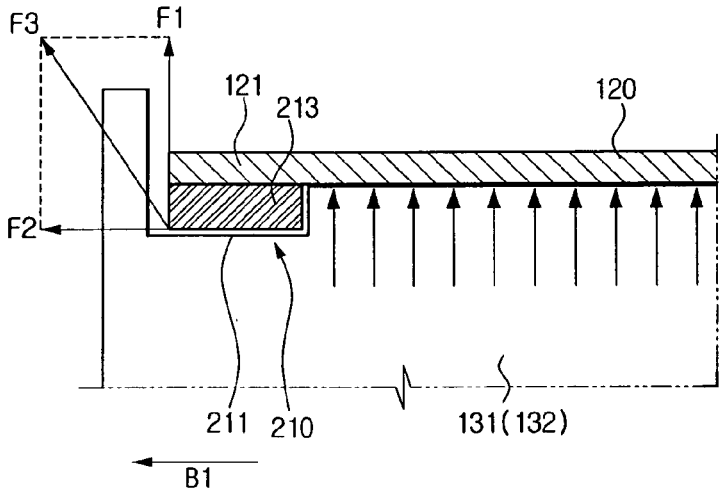
FIGS. 4 and 5 are structure diagrams illustrating major parts of FIG. 3, respectively.

That is, as illustrated in FIG. 4, the intermediate transfer belt 120 receives a tension force F1 in a perpendicular direction to the moving direction thereof by pressurization from the tension roller 132. In addition, a control force F2 is applied to the intermediate belt 120 in the axial direction of the roller 131 by the mechanical structure of the guide rail 210, namely, by contact between the guide groove 211 and the guide rib 213. The other side of the intermediate transfer belt 120 may shift in a B1 direction due to a sum force F3 of the tension force F1 and the control force F2.

Figure 5:
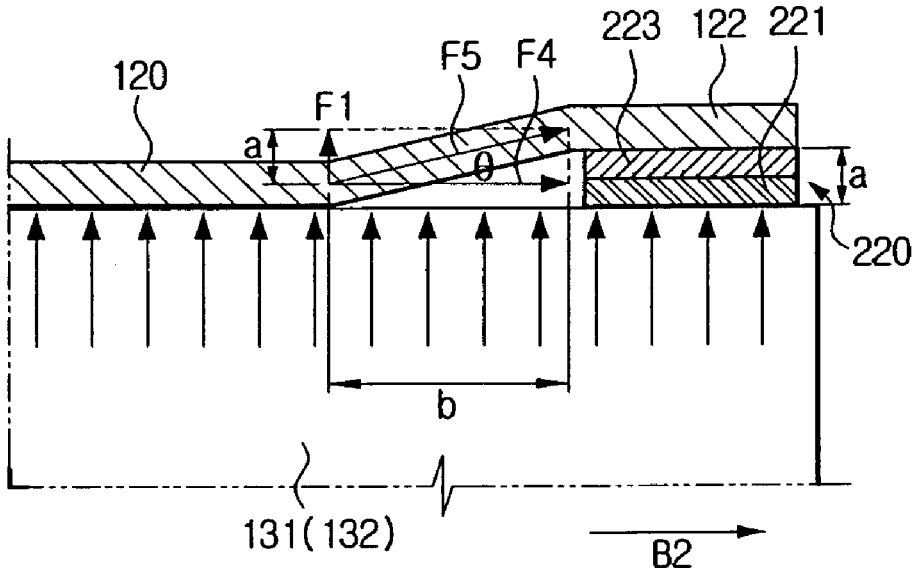

The belt pressurizing member 220 compensates for shifting of the intermediate transfer belt 120 generated by forming the guide rail 210 at one side thereof. As illustrated in FIG. 5, the belt pressurizing member 220 includes a reinforcing film 221 formed on an inner surface of the other side 122 of the intermediate transfer belt 120, and an adhesive 223 positioned between the reinforcing film 221 and the intermediate transfer belt 120. The reinforcing film 221 is adhered to the inner surface of the intermediate transfer belt 120 by the adhesive 223, such as, for example, a double-sided tape. The reinforcing film 221 is formed to a predetermined width, which is thinner than the intermediate transfer belt 120, and thicker than the adhesive 223. When the reinforcing film 221 is adhered to the inner surface of the other side 122 of the intermediate transfer belt 120, a step difference is generated at the other side 122 of the intermediate transfer belt 120. A tension F4 is generated in the B2 direction at the other side 122 of the intermediate transfer belt 120 due to the step difference. A sum force F5 of the tension F4 and the tension F1 applied to the intermediate transfer belt 120 is applied in an opposing direction to the direction of the sum force F3 generated by the guide rail 210, thereby preventing shifting of the intermediate transfer belt 120 toward the guide rail side 210, namely, shifting of the intermediate transfer belt 120 in the direction B1.

The reinforcing film 221 can be a polyethylene terephthalate (PET) film, and the adhesive 230 can be a double-sided tape. In addition, the intermediate transfer belt 120 can be made of conductive polymide (PI). Young's module of the intermediate transfer belt 120 is 2000 Mpa, and the thickness thereof ranges from approximately 65 to approximately 85 μm.

The adhesive 230 can have a thickness of approximately 30 μm, which is maintained constant regardless of the thickness of the reinforcing film 221. The thickness of the reinforcing film 221 ranges from approximately 40 μm to approximately 80 μm. That is, when the adhesive has a constant thickness of approximately 30 μm, the thickness of the belt pressurizing member 220 ranges from approximately 70 μm to approximately 110 μm, thereby generating sufficient tension to prevent shifting of the intermediate transfer belt 120. Conversely, when the thickness of the reinforcing film 221 is below 40 μm, the tension is not sufficiently generated, and when the thickness of the reinforcing film 221 is over 80 μm, the intermediate transfer belt 120 may not stably move due to mechanical problems.

Table 1 shows experiment analysis results of generation or non-generation of shifting of the intermediate transfer belt 120 in movement by thickness variations of the reinforcing film 221.

TABLE 1

| | | | | | | | |
|---|---|---|---|---|---|---|---|
| Thickness of Adhesive | 30 μm | 30 μm | 30 μm | 30 μm | 30 μm | 30 μm | 30 μm |
| Thickness of reinforcing film | 20 μm | 40 μm | 50 μm | 60 μm | 70 μm | 80 μm | 100 μm |
| Result | NG | OK | OK | OK | OK | OK | NG |

The results of Table 1 are easily verified by calculating the tension generated by the step difference of the other side 122 of the intermediate transfer belt 120 from the thickness of the belt pressurizing member 220 and other mechanical conditions in consideration of the physical property of the intermediate transfer belt 120 by using following Formula 1.

$$F(\text{tension})=A\times E/(I\times\delta) \qquad \text{Formula 1}$$

Figure 6:
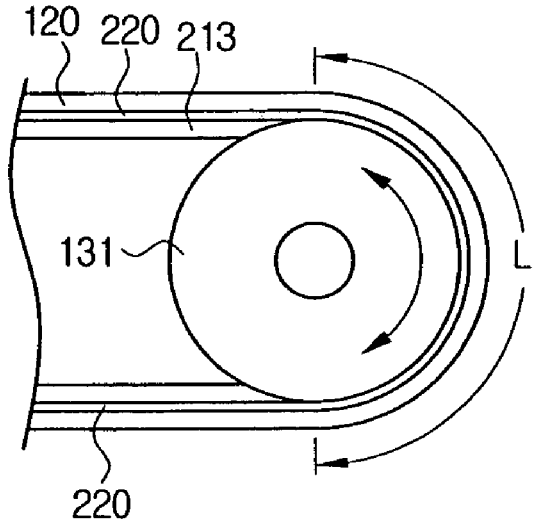
FIG. 6 is a structure diagram illustrating the intermediate transfer belt and the supporting roller seen from a C direction of FIG. 3.

Referring to FIGS. 5 and 6, in the above Formula 1, A represents the contact length L of the intermediate transfer belt 120 and the driving roller 132 in the rotating direction× the thickness T of the intermediate transfer belt 120; E represents Young's module (2000 Mpa) of the intermediate transfer belt 120; I represents the width of the intermediate transfer belt 120; δ represents the extended length of the intermediate transfer belt 120 ($\sqrt{a^2+b^2}-b$, $b=a/\tan\theta$); θ represents the inclination angle by the step difference of the intermediate transfer belt 120; a represents the thickness of the belt pressurizing member 220; and b represents the step difference distance of the intermediate transfer belt 120.

In Formula 1, it is presumed that the thickness T of the intermediate transfer belt 120 is approximately 0.065 mm, E is 2000 Mpa, A is 47.2 mm×0.065 mm, I is 240 mm, and θ is 6.52° regardless of the thickness of the reinforcing film 221.

In the above conditions, when the thickness of the reinforcing film 221 is changed to 20, 40, 50, 60, 70 and 80 μm, the tension by the step difference generated on the intermediate transfer belt 120 is calculated by Formula 1. Table 2 illustrates the calculation results.

TABLE 2

| | Thickness of Reinforcing film | | | | | |
|---|---|---|---|---|---|---|
| | 20 μm | 40 μm | 50 μm | 60 μm | 70 μm | 80 μm |
| a (mm) | 0.05 | 0.07 | 0.08 | 0.09 | 0.1 | 0.11 |
| b (mm) | 0.4375 | 0.6125 | 0.6999 | 0.7875 | 0.875 | 0.9625 |
| δ (mm) | 0.00285 | 0.003987 | 0.004556 | 0.005126 | 0.0057 | 0.006265 |
| F (N) | 0.073 | 0.102 | 0.1165 | 0.131 | 0.1456 | 0.16 |

As illustrated in Tables 1 and 2, in the above conditions, when the tension generated on the intermediate transfer belt 120 by the belt pressurizing member 220 is at least over 0.1 N, shifting of the intermediate transfer belt 120 is prevented. These conditions are efficient when the reinforcing film 221 has a thickness over 40 μm. In the case that the reinforcing film 221 has a thickness over 80 μm, a serious step difference is generated on the intermediate transfer belt 120, which causes shifting or instable movement.

On the other hand, the above experiment results and formula are obtained with the presumption that θ is 6.52° regardless of variations of 'a'. Therefore, a slight error may exist. However, it is recognized that such an error does not affect the effects of the present general inventive concept.

As discussed supra, in accordance with the image forming apparatus of the present general inventive concept, a guide rail is formed at one end of a movable belt such as an intermediate transfer belt, to prevent shifting of the belt in a sideways direction, and a belt pressurizing member to form a step difference by contacting an outer circumference of a supporting roller and outwardly pressurizing the movable belt is formed at the other end of the movable belt, to prevent shifting of the movable belt in the other sideways direction by the tension generated on the movable belt by the step difference.

That is, the shifting of the movable belt by a guide rail formed at one end of the movable belt is offset by a belt pressurizing member formed at the other end of the movable belt. As a result, shifting of the movable belt can be efficiently restricted with a simple structure and a small number of components.

Accordingly, reliability of the image forming apparatus can be improved by efficiently restricting shifting with a small number of components.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to prevent shifting of a movable belt used in an image forming device, the apparatus comprising:

a supporting roller to support the movable belt; and a first shift preventing unit included with the movable belt to be coupled to an end of the support roller to prevent the movable belt from shifting along an axial direction of the supporting roller and a second shift preventing unit included with the roller to be coupled to a bottom surface of the moveable belt to prevent the movable belt from shifting along the axial direction of the supporting roller, the first shift preventing unit being different from the second shift preventing unit and positioned at an end of the supporting roller opposite the second shift preventing unit.

2. The apparatus according to claim 1, wherein the first shift preventing unit includes a guide rail formed between the movable belt and the supporting roller to guide movement of the movable belt.

3. The apparatus according to claim 2, wherein the second shift preventing unit includes a belt pressurizing member to generate tension on the movable belt to compensate for a shifting force generated by forming the guide rail of the first shift preventing unit.

4. An apparatus to prevent shifting of a movable belt used in an image forming device, the apparatus comprising:

a supporting roller to support the movable belt;

a first shift preventing unit included with the movable belt to be coupled to an end of the support roller to prevent the movable belt from shifting along an axial direction of the supporting roller to prevent the movable belt from shifting along an axial direction of the supporting roller; and a second shift preventing unit different from the first shift preventing unit and included with the roller to be coupled to a bottom surface of the moveable belt and positioned at a second end of the supporting roller opposite from the first end to prevent the movable belt from shifting along an axial direction of the supporting roller.

* * * * *